United States Patent [19]

Klemm

[11] 4,006,665

[45] Feb. 8, 1977

[54] PERCUSSION TOOL

[75] Inventor: Günter Klemm, Olpe, Germany

[73] Assignee: Fa. Ingenieur Gunter Klemm Spezialuntrnehmen fur Bohrtechnik, Olpe, Germany

[22] Filed: May 1, 1975

[21] Appl. No.: 573,743

[30] Foreign Application Priority Data

June 11, 1974 Germany ..... 2428236
Dec. 27, 1974 Germany ..... 2461633

[52] U.S. Cl. ..... 91/278; 91/300; 91/321

[51] Int. Cl.[2] ..... F01L 25/04; F01B 7/18

[58] Field of Search ..... 91/278, 321, 300, 282, 91/283

[56] References Cited

UNITED STATES PATENTS

| | | | |
|---|---|---|---|
| 354,660 | 12/1886 | Sergeant | 91/278 |
| 909,923 | 1/1909 | Mitchell | 91/278 |
| 3,552,269 | 1/1971 | Arndt | 91/278 |
| 3,780,621 | 6/1971 | Romell | 91/278 |

FOREIGN PATENTS OR APPLICATIONS

| | | | |
|---|---|---|---|
| 994,333 | 1951 | France | 91/278 |

*Primary Examiner*—Paul E. Maslousky
*Attorney, Agent, or Firm*—Diller, Brown, Ramik & Wight

[57] ABSTRACT

This disclosure relates to a percussion tool which includes a housing having a chamber reciprocally mounting a piston with first and second pressure ducts at opposite ends of the latter and a control duct therebetween as well as a return duct in fluid communication with the chamber at a point intermediate the points of entry of the first and second pressure ducts and reciprocal valve means for controlling the reciprocal motion of the piston, the improvement including a plurality of branch ducts of the control duct opening into the chamber in such a fashion that the branch ducts are successively opened and closed during the reciprocation of the piston.

10 Claims, 2 Drawing Figures

PERCUSSION TOOL

The present invention is directed to improvements in a percussion tool of the type disclosed in application Ser. No. 503,057 in the name of Gunter Klemm entitled PERCUSSION TOOL filed on Sept. 4, 1974 and now U.S. Pat. No. 3,908,767.

The percussion tool of the present invention includes a reciprocally mounted working piston hydraulically movable in a working cylinder which, depending upon the position of the piston, connects alternately various ones of pressure lines or ducts, return lines or ducts, control lines or ducts, etc. for controlling the operation of the working piston.

In known percussion tools a control duct is in fluid communication between a working cylinder or chamber in which is housed a reciprocal cylinder and a control valve housing. The working piston and its cylinder or chamber are of generally the same diameter with full pressure being applied to one side of the piston while the other side thereof is not under pressure. Depending upon the particular location of the working piston during its stroke or reciprocation the control duct is either connected to the high side or the pressure-free side of the working piston. The conventional piston in this type percussion tool must have a certain minimum height to necessarily seal the chamber at various times during its stroke by opening or closing ducts communicating with the interior of the piston chamber. Since the working piston requires a relatively long stroke there is a long non-operative time between cycle reversals and thus the number of impacts per minute in conventional percussion tools of this type are relatively low.

In another known hydraulic percussion tool a control duct opens into the working cylinder or chamber through a plurality of branch ducts which are progressively closed by the advancement of a pin to permit changes in the reversal point of the reciprocal piston and thereby also adjust the percussion energy output. If the blocking pin is not provided the branch ducts function collectively and, as opposed to the present invention which will be described more fully hereinafter, another conventional portion of the control duct is completely unbranched or stated otherwise lacks branched ducts.

In another conventional compressed air percussion tool the control valve is formed as a hollow sleeve with the ends and interior thereof constantly subjected to high input pressure. The control valve or valve sleeve comprises an annular collar arranged in an annular space of a control cylinder with the collar being connected through a control duct to the working cylinder or chamber housing the reciprocal working piston. The purpose of the control duct is to reverse the motion of the valve sleeve into one of its end-most positions while the reversal of the valve sleeve to its other end position is effected by the return stroke of the working piston. This structure requires that the pressurized medium be compressable.

It is known from practice that the number of blows or impacts of conventional hydraulic percussion tools is normally about 700 impacts per minute with a maximum at 3,500 to 4,000 impacts per minute. This low rate of impact is due to the slow reversing reciprocation of the control valve which occurs before the working piston has reached either of its respective end positions and generally occurs too late at one side or the other of its reciprocation. The reason for this delayed reversal is because the known valves are generally heavy solid masses and are thus sluggish in their motion, particularly when it is recognized that percussion tools of this type require large flow quantities of the hydraulic media for an extremely short time period during continuous cycling of the tool.

In keeping with this invention the percussion tool is capable of operating at extremely high percu-sion rates, whether the control valve is solid or tubular, although the latter is preferred, due to the provision of providing the control duct which is in communication with the valve chamber with a plurality of groups of branch ducts opening into the working chamber with the branch ducts being so arranged that they are successively opened and closed or vice versa during the reciprocation of the working piston.

The percussion tool of this invention is so constructed that a first of the branch ducts connects the control duct to a return line which is not under pressure when the piston cuts off fluid communication with an associated pressure line. In this position virtually all branch ducts are cut off but if thereafter the piston moves a small increment a first of the branch ducts is opened and connected to a corresponding pressure line or return line, respectively, so that corresponding control pressures are transmitted through the control duct to the control valve. Due to this construction the overall length of the working piston can be altered to provide freedom of design and choice for specific job applications without a sacrifice in output impacts.

In the preferred embodiment of the invention it is possible to control the number of impacts or to adjust the lower point of reversal of the working piston by a first group of branch ducts all of which communicate with the working chamber and with the control duct in such a manner that these branch ducts are closed independently of one another without closing the control duct. Any of these first branch ducts (if not closed by a plug for adjusting purposes) determines within the piston cycle that moment at which the control duct is connected to the unpressurized return line so that control pressure upon the control valve is decreased and reversal of the control valve is initiated. By the control ducts being successively closed by the motion of the piston the piston itself can be reversed at a later time in its working direction of motion (downward) which in turn reduces the number of blows or impacts and, of course, increases the energy of each individual blow.

The reversal of the working piston at its upper reversal point is desirably unaffected by any sudden reversal of pressure but instead only by a progressive reduction or weakening of the piston speed. This is achieved by a second plurality of branch ducts, again connected to the control duct, which open successively into the working chamber and thereby increase the flow to the control duct with an increasing stroke of the working piston. Consequently, with an increase in working piston stroke the working piston uncovers an increasing number of the second branch ducts while the first branch ducts are completely closed and as a result the pressure can be slowly built up in the control duct which provides a smooth reversal of the control valve without any jarring. Throttle elements of the type disclosed in applicant's latter-noted disclosure may be arranged in the second branch ducts.

As in the case of applicant's latter noted disclosure the control valve is a hollow control valve or valve sleeve which is constantly exposed to high pressure through its interior and on its axially opposite end faces and additionally includes an annular collar medially of its end faces forming a control surface in fluid communication with the control duct and with the piston chamber through the branch ducts heretofore described. The valve sleeve, due to its annular construction, is capable of passing large flow quantities while being of a very small mass inertia because of minimum wall thickness. The valve sleeve may be biased hydraulically or by a mechanical spring and in either case only a single control duct is necessary for the controlled reciprocation of the valve sleeve for effecting reciprocation of the working piston.

It is also a preferred aspect of this invention to construct the valve sleeve identically as that disclosed in applicant's latter identified disclosure, particularly in regard to the differences in the areas of the axial end faces thereof, the annular working area, the relief areas and a larger of the end faces, and an annular relief groove formed in the valve sleeve between input points of the control duct and one of a pair of pressure ducts which open respectively into opposite ends of the working chamber.

In the case of hammer drills or similar percussion tools in which a flushing line or pipe passes through a linkage connected to an anvil the flushing tube passes through a longitudinal bore of the working piston and an air space is provided between the wall of the bore and the flushing tube. This air space provides for a balancing of pressure during the reciprocal motion of the working piston and in this way any pressure damping effects are avoided and constant cooling is achieved by the steady motion of air within the working chamber. Moreover, the reciprocation of the piston forms a partial mist from the pressurized fluid and this additionally lubricates the piston during its reciprocation in the working cylinder. However, even if a flushing tube is not provided the construction is such that the piston can have a longitudinal bore therethrough so as to avoid shock damping and energy absorbing action by air cushion effects which would take place if otherwise unprovided for.

In conventional percussion tools it is known to provide a hydropneumatic two-chamber pressure accumulator separated by a membrane with one of the chambers connected to the pressure duct of the percussion tool. A shut-off valve is generally disposed between a duct leading to a chamber of the shut-off valve into which also enters the inlet duct and a pressure duct. This shut-off valve is operative when the pressure on the system drops below a predetermined value which is generally above the normal working pressure of the system. Though such shut-off valves are known, in keeping with the present invention a shut-off valve is provided which is operative only when the hydraulic pressure in the inlet duct is interrupted by the shutting down of the percussion tool which prevents entrapped high pressure from abruptly discharging into the pressure accumulator. The latter is undesired because the membrane heretofore described is slung or moved with great energy impact and in practice frequently breaks as a consequence thereof. The shut-off valve of this invention makes it possible to prevent this high energy motion of the membrane of the accumulator.

With the above and other objects in view that will hereinafter appear, the nature of the invention will be more clearly understood by reference to the following detailed description, the appended claimed subject matter, and the several views illustrated in the accompanying drawings.

Figure 1:
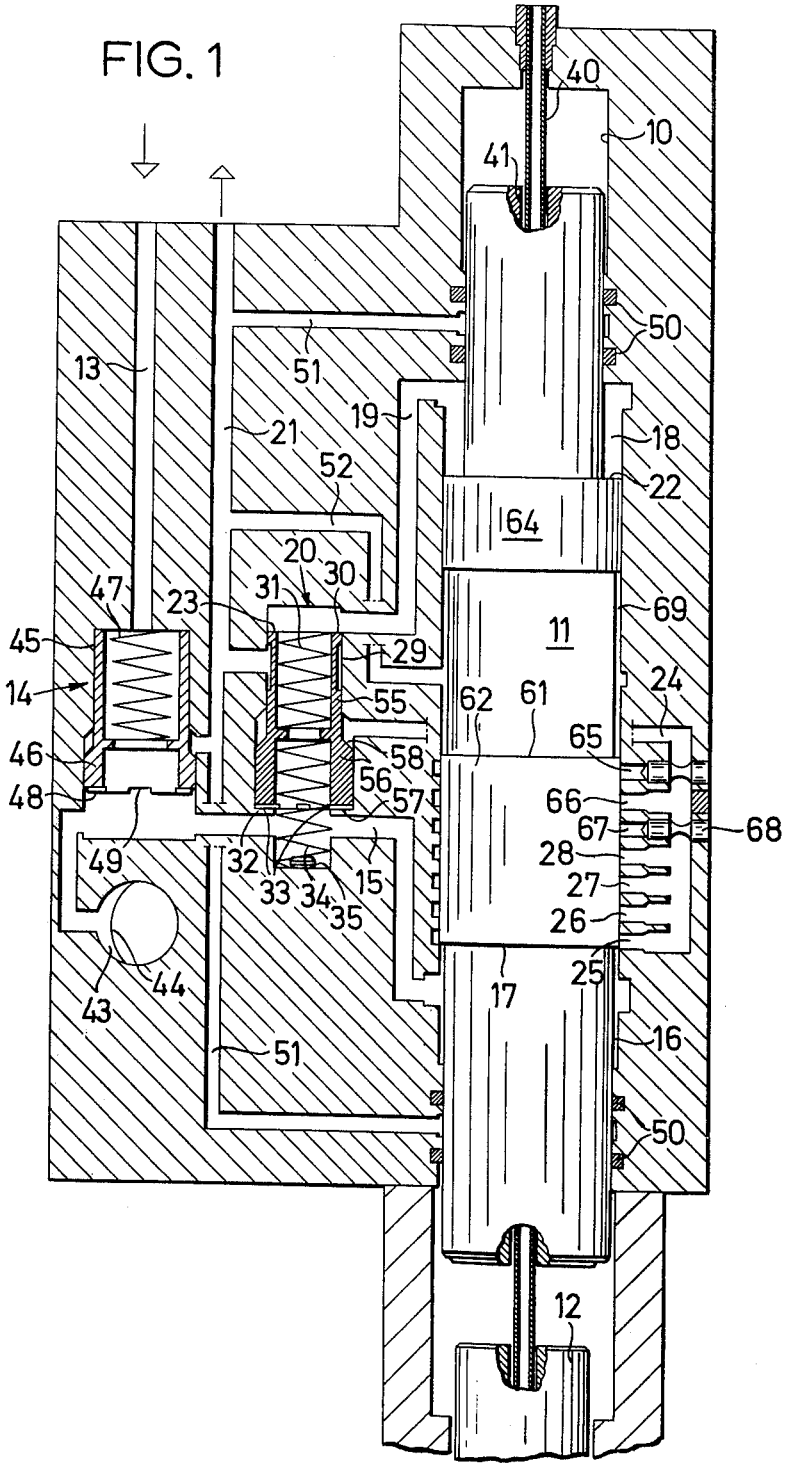
FIG. 1 is a cross-sectional view of a percussion tool constructed in accordance with this invention, and illustrates an annular hollow control valve or valve sleeve operative to control the flow of hydraulic fluid to a working piston reciprocally mounted in a working cylinder or chamber.

Referring first to FIG. 1, a percussion tool includes a working cylinder or chamber 10 within which is mounted for reciprocal motion a working piston 11. Upon the control of rapid reciprocation of the piston 11 its lower end face (unnumbered) strikes at intervals upon an anvil 12 which may, for example, be connected to a conventional drilling linkage.

A high pressure inlet duct or line 13 supplies a fluid medium, which is preferably hydraulic, under pump pressure of approximately 80 bar to a pressure duct or line 15 and alternately to a pressure duct or line 19 through a shut-off valve 14 and a control valve 23, both of which valves are in the form of hollow annular sleeves. The pressure duct 15 is permanently connected to a lower chamber portion 16 of the chamber 10 and to a lower portion (unnumbered) of a bore or cylinder 20 within which the valve sleeve 23 is reciprocally mounted so that pressure will act against a shoulder or annular surface 17 of the piston 11 which faces downwardly, as viewed in FIG. 1. This pressure from the pressure duct 15 acting against the annular surface 17 of the piston 11 tends to move the piston 11 in an upward direction.

An upper chamber portion 18 of the chamber 10 is connected to the bore or cylinder 20 by the pressure duct 19 and depending upon the position of the valve sleeve 23, the duct 19 may be cut off in its communication with a return duct 21, as shown in FIG. 1, or may be placed in fluid communication therewith, as will be described more fully hereinafter, upon movement of the valve sleeve 23 to its uppermost postion. Thus the pressure duct 19 can be alternately connected to the pressure duct 15 and to the pressure duct 15 in conjunction with a return duct 21.

The piston 11 adjacent the upper chamber portion 18 includes an annular surface 22 facing axially upwardly, as viewed in FIG. 1, and the area of the surface 22 is substantially greater than the area of the surface 17. In the position of the elements illustrated in FIG. 1 like pressure will be directed by the ducts 15, 19 into the chambers 16, 18, respectively, to act against the annular faces or surfaces 17, 22. By virtue of the smaller area of the surface 17, as compared to the surface 22, the piston 11 will be driven upwardly. Likewise, if the pressure from the duct 15 acts only upon the surface 17, assuming that the duct 19 is closed, the piston 11 will also move in its return stroke in an upward direction.

The operation of the control valve or valve sleeve 23 is through a control duct 24 which includes a plurality of branch ducts 25, 26, 27, 28 and 65, 66, 67. The latter branch ducts open into an area 69 between an upper thickened portion 64 and a lower thickened portion 62 of the piston 11. The lower portion 62 of the piston 11 is capable of sequentially opening or closing the branch ducts 25 through 28 and/or 65 through 67 during the reciprocation of the piston 11, as is readily apparent from FIG. 1. The annular area 69 may be considered to be simply a reduced portion of the piston 11 between an upper face 61 of the piston portion 62 and the lower face (unnumbered) of the upper piston portion 64. A return duct 52 is in fluid communication between the portion 69 of the chamber 10 and the outlet duct 21. By the structure thus far described, if the piston 11 is lowered to such an extent that the upper annular surface 61 of the piston portion 62 comes below the first opened branch line 65, 66 or 67 (it being noted that any one or all of these might be closed by a plug 68) then the corresponding branch line or duct 65 through 67 is connected through the annular groove or chamber 69 to the return line 52 as a result of which the control duct 24 is depressurized. The plug 68 is capable of being fitted into the branch ducts 65, 66 and 67 so as to be able to selectively seal these off at will to determine that piston position in which the control duct 24 is rendered pressureless for the first time or initially during the motion of the piston 11 such that pressure acting upon a reaction face 58 of the control valve 23 ceases.

The second branch lines or ducts 25 through 28 are disposed below the first branch lines or ducts 65 through 67 and determine at which point of piston travel the pressure of the pressure line or duct 15 is conducted into the control duct 24. If the working piston 11 is raised from its lowermost position the control duct 24 is first deprived of pressure but if the lower annular surface 17 of the piston 11 reaches a region of the lowermost branch duct 25 then pressurized liquid passes into this branch duct and into the control duct 24. Obviously it is necessary to ensure at the same time that the first branch lines or ducts 65 through 67 are at this moment already closed which does in fact occur. The build-up of pressure in the control duct 24 occurs slowly as the first branch duct 25 is exposed to the lower chamber portion 16 but as the remaining branch ducts 26, 27, 28 become opened with increasing upward piston travel the larger becomes the exposed cross-sectional area of the control duct 24 opening into the lower chamber 26 and because of this successive increase in pressure the control sleeve 55 of the valve 23 is reversed relatively steadily.

As was briefly described heretofore, the operation of the control valve or valve sleeve 23 is through the control duct 24 which enters the bore or cylinder 20 at an annular portion 55 thereof such that fluid pressure impinges against the surface 58 of an annular collar 56. Above the surface 56 of the valve sleeve 23 the latter is provided with a circumferentially radially outwardly opening groove or recess 29 which is intermittently places into fluid communication with the pressure duct 19 and the return duct 21. When the valve sleeve 23 is in the position illustrated it will be noted that pressure is exerted upon an axial end face 30 of the valve sleeve 23, as well as upon an end face 33 of a larger area opposite the end face 30. The end face 33 has a series of circumferentially disposed groove or indentations 57 which oppose a seat 32 upon which rests the high side of the face 33. A spring 31 biases the valve sleeve downwardly while a spring 34 located conventionally by an element 35 normally biases the valve sleeve 23 upwardly. It is further pointed out that the total surface area of the surfaces 30, 58 is identical to that of the surface area of the surface 33.

As thus far described the operation of the percussion tool is as follows:

Beginning with the position of the parts as illustrated in FIG. 1 the valve sleeve 23 connects the duct 19 with the pressure duct 15 and cuts off communication to the return duct 21. As full line pressure of the inlet duct 13 acts on the upper larger annular surface 22 of the piston 11 as well as on the lower smaller annular surface 17 of the piston 11 the piston 11 is accelerated in a downward direction. In doing so the enlarged portion 62 of the piston 11 progressively and successively closes the branch ducts 28, 27, 26, and 25 and thereafter uncovers the branch ducts 65, 66 and 67 except, of course, any of those which are closed by the plugs 68. When the lowermost branch duct 25 is closed the control duct 24 is cut-off from high pressure within the lower chamber 16 and with the opening of the branch duct 65 the control duct 24 is placed in fluid communication with the return duct 52 through the annular chamber 69 between the large portions 64, 62 of the piston 11. As a consequence the hydraulic force which is acting upon the annular reaction surface 58 of the control valve 23 is progressively reduced whereas high pressure still acting upon the larger annular end face 57 of the control valve 23 moves the latter upwardly against the bias of the spring 31. The control valve 23, though initially seated upon the valve seat 32 thereof begins to rise as the high pressure through the indentations 58 acts against the lower face and in conjunction with the upward biasing force of the spring 34 lifts the control valve 23 until the upper end face 30 is sealed against the uppermost end of the control valve bore.

With the control valve 23 in its uppermost position the pressure duct 19 is cut-off from the inlet duct 13 and is instead connected to the return duct 21 through the annular groove 29 of the control valve 23. The upper chamber 18 is therefore relieved of pressure whereas pressure communicated into the lower chamber 16 through the pressure duct 15 is still effective to act against the annular surface 17 and drive the piston 11 upwardly. During the latter motion the branches 25, 26, 27 and 28 are successively uncovered and liquid under pressure from the chamber 16 flows therethrough into the control line 24 which progressively increases until the pressure in the control line or duct 24 reaches such a level that it is sufficient when acting upon the annular surface 58 to once again drive the valve sleeve downwardly to the position shown in FIG. 1. Due to this low pressure build-up in the control line 24 the control valve 23 is gently lowered during its downward movement so that the pressure duct 19 does not abruptly admit high pressure into the chamber 18. The effect of this progressive motion of the valve sleeve 23 is the slow and steady breaking of the piston 11 in the absence of the sudden build-up of an impressable hydraulic cushion within the chamber 18 as well as the chamber 16 upon opposite motion of the piston 11.

If the percussion tool thus far described is used in conjunction with drilling fixtures, it may be provided with a flushing pipe 40 which passes longitudinally through a bore 41 of the working piston 11 as well as a bore (unnumbered) of the anvil 12. The diameter of the bore 41 is greater than the exterior diameter of the flushing pipe 40 so that there is an annular air space between the two. The pipe 40 is fixed and the piston reciprocates relative thereto in the manner heretofore described and in so doing air is continually pumped between the chambers (unnumbered) at axial opposite ends of the piston 11. This produces a cooling action internally of the piston 11 as well as within the bore 10 and also ensures lubrication because the air contains leaked oil in the form of mist. This oil and air admixture is therefore in effect pumped to all places where friction can arise to reduce wear of relatively moving parts within the chamber 10. Moreover, an air cushion cannot be formed at axially opposite ends of the piston 11 and opposing portions of the chamber 10 which would undesirably absorb the impact energy transmitted or desired to be transmitted by the piston 11 to the anvil 12.

The inlet duct 13 is also connected to a hydropneumatic pressure accumulator 43 which consists of a chamber containing gas under high pressure and a second chamber which is directly connected by a duct (unnumbered) to the inlet duct 13 or to the pressure duct 15. The two chambers of the accumulator 43 are separated from each other by a rubber membrane 44. The purpose of the pressure accumulator 43 is to absorb excessive pressure during the cycling of the tool particularly when only a little pressure is required whereas at times when higher pressure is required such an be made available from the accumulator 43. Through the use of an accumulator of this type the pressure from the pump associated with the inlet duct 13 need not meet the maximum value of the tool but only a mean value between high and low fuel requirements as the accumulator pressure could be used to augment the same.

One difficulty of known pressure accumulators of the type described in which two chambers are separated by a membrane is that when the inlet duct 13 becomes pressure free the membrane 44 is slung or driven against the wall of the accumulator under high impact due to high pressure within the system resulting in fracture or breakage of the membrane. In actual practice such fracture arises when the pump pressure leading to the inlet 13 is switched off and entrapped high pressure within the system abruptly purges toward and into the accumulator 43 and against the membrane 44 thereof.

In order to avoid the latter-mentioned difficulties the shut-off valve 14 has been provided and like the control valve 23 it is in the form of an annular valve or valve sleeve 45 having at its lower end a collar 44 and an axial end face 48 having grooves or indentations 49. A spring 47 normally biases the valve sleeve 45 in a downward direction and is so rated that the pressure acting upon the bottom face 48 normally drives the valve sleeve 45 upwardly. The valve sleeve 45 will move downwardly only when the pressure in the inlet duct 13 falls below, for example, 70 bar and is no longer able to act against the spring 47. The normal pressure in the pressure accumulator under this example is approximately 50 bar.

In the open position of the valve sleeve 45 the inlet duct 13 is connected with the pressure accumulator 43 and with the pressure duct 15 through the interior of the valve sleeve 45. If the pressure in the pressure duct 15 falls below 70 bar then the valve sleeve 45 drops down and separates the three ducts 13, 15 and the unnumbered duct from the accumulator 43 from each other. The pressure prevailing within the chamber 10 cannot now be released abruptly into the accumulator 43 because the duct 15 is closed off therefrom by the collar 46 of the valve sleeve 45. However, due to the indentations or grooves 49 the pressure within the chamber 16 will bleed slowly into the accumulator 43 and undesired impact forces against the membrane 44 is thus precluded.

The percussion tool also includes conventional seals 50 as well as leak ducts 51 which open into the return duct 21 to return any fluid which leaks past the seals 50 or within the annular chamber 69 between the enlarged portions 62, 64 of the piston 11.

Figure 2:
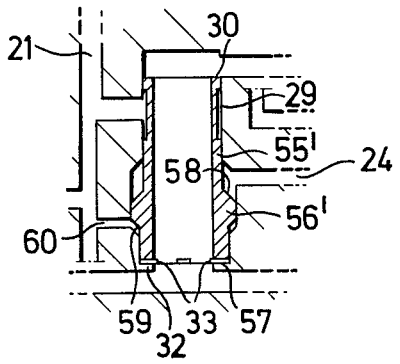
FIG. 2 is a fragmentary sectional view through a modified construction of an annular control valve or valve sleeve, and due to the construction thereof the same is operative in the absence of a mechanical biasing spring.

Reference is now made to FIG. 2 of the drawing which illustrates an embodiment of the invention in which springs corresponding to those bearing reference numerals 31 and 34 in FIG. 1 are eliminated. In this case the valve 23' is slightly modified relative to the construction of the valve sleeve 23. The valve sleeve 23' has an annular or circumferential collar 56' having axially opposite faces 30, 33 the latter of which is of a greater surface area than the former. The collar 56' includes opposite inclined faces 58, 59 which are in respective communication with the ducts 24, 21 with the latter being accomplished through a branch duct 60. Indentations 57 are also formed in the face 33 and these operate in conjunction with a seat 32 in the manner described relative to the valve 23 of FIG. 1. The control of the valve sleeve 23' is exclusively hydraulic. The high pressure acts continually upon the larger surface area 33 and the similar smaller surface 30. If the pressure in the control duct 24 is low then the force acting upon the face 33 becomes superior and the valve sleeve 23' is raised upwardly. If the pressure in the control duct 24 increases then the forces acting upon the faces 30 and 58 exceed that force which acts upon the face 33 and the control valve sleeve 23' moves downwardly. It is recognized that the pressure from the control duct 24 acting upon the rear face 58 of the collar 56' is exclusively decisive for the postion of the control valve sleeve 23' at that time.

The advantage of the construction of the embodiment of the invention illustrated in FIG. 2 consists in that no type of spring or springs are necessary to produce a pretension or to lift the valve sleeve. The production is therefore simplified in wear of relatively moving parts is lessened. However, both as to the valve sleeves 23 and 23', each has the advantage that the adjustment movement thereof is introduced through a single duct, namely the control duct 24. The control duct 24 at the end entering the cylinder 20 has no branches and enters the cylinder 20 at but one point. Thus the piston faces or surfaces of the control sleeves 23, 23' are, with the exception of the face 58 always subjected to the same pressure whereby simple ducting is achieved and the number of control ducts from the working cylinder 10 to the control valve cylinder 20 is reduced simply to one.

While preferred forms and arrangements of parts have been shown in illustrating the invention, it is to be clearly understood that various changes in detail and arrangement of parts may be made without departing from the spirit and scope of this disclosure.

I claim:

1. A percussion tool comprising a housing defining a chamber within which is reciprocally mounted a piston, first and second pressure ducts in fluid communication with said chamber at respective first and second sides thereof, a return duct in fluid communication with said chamber at a point intermediate the points of entry of said first and second pressure ducts relative to said chamber, an inlet duct for delivering a pressurized fluid to said pressure ducts, movable valve means for alternately placing said inlet and pressure ducts in fluid communication in a first position of said valve means for moving said piston in a first direction and placing said first pressure and return ducts in fluid communication in a second position of said valve means while at the same time maintaining fluid communication between said inlet and second pressure ducts and closing communication between said inlet and first pressure ducts for moving said piston in a second direction opposite said first direction, said piston being thereby movable between axially opposite and terminal first and second positions, said valve means being mounted for reciprocal motion in a bore, said first and second pressure ducts opening into said bore, said return duct opens into said bore between the points of entry of said first and second pressure ducts relative to said bore, control duct means opening into said bore at a point of entry between the points of entry of said return and second pressure ducts and having at least two branch duct means opening into said chamber at points spaced from each other in the direction of piston reciprocation, a first of said branch duct means being placed in fluid communication with said return duct through said chamber when said piston is in said first position, and a second of said branch duct means being placed in fluid communication with said second pressure duct when said piston is in said second position.

2. The percussion tool as defined in claim 1 wherein said first and second branch duct means each include a plurality of branch ducts which open and close successively during the reciprocation of said piston.

3. The percussion tool as defined in claim 1 wherein said valve means is an annular open ended valve sleeve, and said first and second pressure ducts open into said bore at axially opposite ends thereof whereby fluid communication may be established between said first and second pressure ducts through said valve sleeve.

4. The percussion tool as defined in claim 3 wherein said valve sleeve has first means at an outer peripheral surface thereof for placing said first pressure and return duct in fluid communication in said second position.

5. The percussion tool as defined in claim 4 wherein said valve sleeve has second means on its outer peripheral surface for moving said valve sleeve from its first to its second position under the impingement of fluid thereagainst, and said control duct so opens into said bore for impinging fluid pressure upon said second means.

6. The percussion tool as defined in claim 3 wherein said valve means has an annular collar on its outer peripheral surface, said collar includes oppositely facing annular surfaces, said control duct opens into said bore for impinging pressurized fluid upon a first of said faces, a duct for placing said bore adjacent a second of said faces in fluid communication with said return duct, and the area of said first face being greater than the area of said second face.

7. The percussion tool as defined in claim 3 including spring means biasing said valve sleeve in a direction toward said second position.

8. The percussion tool as defined in claim 3 wherein said valve sleeve has first means at an outer peripheral surface thereof for placing said first pressure and return ducts in fluid communication in said second position, and said first means is a radially outwardly opening circumferential groove in said valve sleeve outer peripheral surface.

9. The percussion tool as defined in claim 3 wherein said valve means has an annular collar on its outer peripheral surface, said collar includes oppositely facing annular surfaces, said control duct opens into said bore in such a manner as to impinge pressurized fluid upon a first of said faces, a duct for placing said bore adjacent a second of said faces in fluid communication with said return duct, the area of said first face being greater than the area of said second face, said valve sleeve includes an annular terminal end face at an axial end of said valve sleeve disposed adjacent said second pressure duct, said bore includes an annular seat against which abutts said terminal end face in said first position, and a plurality of grooves in said terminal end face whereby fluid pressure acting between said grooves and an annular seat apply a force acting in a direction tending to move said valve sleeve from said first to said second position.

10. The percussion tool as defined in claim 3 wherein said piston has a pair of enlarged piston portions spaced by a narrower portion which with said chamber defines an annular gap for placing said control duct in fluid communication with said return duct.

* * * * *